US007784455B1

(12) United States Patent
Chong

(10) Patent No.: US 7,784,455 B1
(45) Date of Patent: Aug. 31, 2010

(54) REUSABLE PELLET SHOOTING GRENADE

(76) Inventor: Carlton le Loong Chong, 4978 Yonge Street, Suite 3606, Toronto, Ontario (CA) M2N 7G8

( * ) Notice: Subject to any disclaimer, the term of this patent is extended or adjusted under 35 U.S.C. 154(b) by 531 days.

(21) Appl. No.: 11/898,939

(22) Filed: Sep. 18, 2007

(51) Int. Cl.
*F41B 11/00* (2006.01)

(52) U.S. Cl. ..... 124/73; 102/498; 102/513; 124/70; 124/75

(58) Field of Classification Search ..... 102/498, 102/482, 502, 513; 124/70–73, 75
See application file for complete search history.

(56) References Cited

U.S. PATENT DOCUMENTS

| | | | | |
|---|---|---|---|---|
| 1,737,833 | A | 12/1929 | D'Orsaneo | |
| 2,051,331 | A | 8/1936 | De Bobula | |
| 2,897,630 | A | 8/1959 | Horowitz et al. | |
| 3,019,554 | A | 2/1962 | Rago | |
| 3,117,521 | A | 1/1964 | Reaves | |
| 3,139,697 | A | 7/1964 | Mier | |
| 3,225,490 | A | 12/1965 | Ostrom | |
| 3,369,486 | A | 2/1968 | Wrennstad et al. | |
| 3,402,665 | A | 9/1968 | Tarpley, Jr. et al. | |
| 3,492,945 | A | 2/1970 | Filippi | |
| 3,878,639 | A | 4/1975 | Scheelar et al. | |
| 4,319,426 | A | 3/1982 | Lee | |
| 4,392,432 | A | 7/1983 | Fenrick et al. | |
| 4,424,972 | A | 1/1984 | Vinette | |
| 4,667,601 | A | 5/1987 | Diamond et al. | |
| 4,684,137 | A | 8/1987 | Armer, Jr. et al. | |
| 4,932,329 | A | 6/1990 | Logie | |
| 4,932,672 | A | 6/1990 | Tippmann | |
| 4,944,521 | A | 7/1990 | Greeno | |
| 5,018,449 | A | 5/1991 | Eidson, II | |
| 5,069,134 | A | 12/1991 | Pinkney | |
| 5,097,816 | A * | 3/1992 | Miller | 124/49 |
| 5,246,372 | A | 9/1993 | Campagnuolo et al. | |
| 5,354,225 | A | 10/1994 | Hix | |

(Continued)

FOREIGN PATENT DOCUMENTS

| | | |
|---|---|---|
| JP | 04-155197 | 5/1992 |

(Continued)

*Primary Examiner*—Troy Chambers
*Assistant Examiner*—Gabriel J Klein
(74) *Attorney, Agent, or Firm*—Elias Borges

(57) ABSTRACT

The present invention is an improved grenade which launches a plurality of pellet projectiles. The grenade includes a housing containing at least one spiral launch tube, said launch tube having a breech end and a muzzle end. A plurality of projectiles are loaded in the launch tube between the breech and muzzle ends. The grenade includes a gas reservoir for storing a compressed gas coupled to the breech end of the launch tube. A valve is interposed between the reservoir and the breech end of the launch tube for controlling the flow of compressed gas from the reservoir to the breech end of the launch tube. The valve is moveable between a closed state and an open state wherein said compressed gas enters the breech end of the launch tube to propel the projectiles from the muzzle end, the valve being biased towards its open state. The grenade also includes a trigger mechanism coupled to the valve, the trigger mechanism operating between a locked state wherein the trigger mechanism holds the valve in its closed state and an unlocked state wherein the valve is free to move into its open state.

19 Claims, 9 Drawing Sheets

U.S. PATENT DOCUMENTS

| | | | | |
|---|---|---|---|---|
| 5,590,886 | A | 1/1997 | Lush | |
| 5,819,715 | A * | 10/1998 | Haneda et al. | 124/6 |
| 5,877,448 | A | 3/1999 | Denton et al. | |
| 5,996,503 | A | 12/1999 | Woodall et al. | |
| 6,065,404 | A | 5/2000 | Ripingill, Jr. et al. | |
| 6,289,819 | B1 | 9/2001 | Dolderer | |
| 6,349,650 | B1 | 2/2002 | Brunn et al. | |
| 6,453,819 | B1 | 9/2002 | Coates | |
| 6,499,477 | B1 | 12/2002 | Brock | |
| 6,543,364 | B2 | 4/2003 | Wes et al. | |
| 6,598,807 | B1 | 7/2003 | Anzalone | |
| 6,688,234 | B2 | 2/2004 | Huber et al. | |
| 6,871,594 | B1 | 3/2005 | Estrella | |
| 7,500,477 | B2 * | 3/2009 | Westmeyer et al. | 124/6 |
| 2006/0196488 | A1 * | 9/2006 | Morshed et al. | 124/49 |

FOREIGN PATENT DOCUMENTS

| | | |
|---|---|---|
| JP | 06-074700 | 3/1994 |
| JP | 08-257157 | 10/1996 |
| JP | 11-223500 | 8/1999 |
| JP | 2002-107097 | 4/2002 |
| JP | 2003-075094 | 3/2003 |

* cited by examiner

REUSABLE PELLET SHOOTING GRENADE

FIELD OF THE INVENTION

The invention relates generally to replica grenades for shooting plastic pellets.

BACKGROUND OF THE INVENTION

Pellet shooting grenades have been available for use in playing war simulation games. These grenades generally consisted of a hollow housing containing a quantity of pellets loosely contained in a chamber which was in close proximity to a pressurized air reservoir. A valve was generally provided between the air reservoir and the pellet containing chamber. Upon opening the valve, the flow of pressurized gas would cause the pellets to be propelled from the chamber. The pellet containing chamber was often made from several sections which would come apart when the valve was opened, thereby permitting the pellets a way of escaping the grenade when the grenade "detonated". In many cases, a chemical propellant was used to create the gas pressure necessary for launching the pellets.

While these prior pellet launching grenades do provide a means to simulate the action of a real hand grenade in a safe and convenient manner, there are a number of draw backs associated with previous designs. Firstly, the method of dispersing or launching the pellets did not impart much kinetic energy to the pellets; thereby greatly limiting the "effective range" of the grenade since the pellets would travel only a short distance. The delay mechanisms used in previous pellet launching grenades to delay the "detonating" of the grenade after the grenade was activated also lacked reliability. Furthermore, previous pellet launching grenade designs were complicated to use and expensive to manufacture. A more economical and reliable grenade design which is capable of more efficiently imparting kinetic energy to the pellets is therefore required.

SUMMARY OF THE INVENTION

In accordance with one aspect of the present invention, there is provided an improved grenade with improved reliability and improved performance. The grenade of the present invention includes at least one spiral launch tube, said launch tube having a breech end and a muzzle end. A plurality of projectiles are loaded in the launch tube between the breech and muzzle ends. The grenade includes a pressure source coupled to the breech end for pressurizing the launch tube sufficiently to launch the projectiles from the muzzle end of the launch tube.

In accordance with another aspect of the invention, there is provided an improved grenade which includes a housing containing at least one launch tube having a breech end and a muzzle end. A plurality of projectiles are loaded in the launch tube between the breech and muzzle ends. The grenade also includes a gas reservoir for storing a compressed gas, the gas reservoir being coupled to the breech end of the launch tube. A valve is interposed between the reservoir and the breech end of the launch tube for controlling the flow of compressed gas from the reservoir to the breech end of the launch tube, the valve moveable between a closed state and an open state wherein said compressed gas enters the breech end of the launch tube to propel the projectiles from the muzzle end, the valve being biased towards its open state. The grenade further includes a trigger mechanism coupled to the valve, the trigger mechanism operating between a locked state wherein the trigger mechanism holds the valve in its closed state and an unlocked state wherein the valve is free to move into its open state. Also, the grenade includes a delay mechanism coupled to the valve for slowing the movement of the valve into its open state. The delay mechanism consists of a liquid reservoir for holding a quantity of liquid, the liquid reservoir having a discharge opening for discharging liquid from the liquid reservoir. The valve is coupled to a piston such that the valve and piston move together, the piston being positioned in the liquid reservoir to force the liquid out of the liquid reservoir as the valve moves into its open position. The discharge opening is dimensioned to delay the movement of the piston by restricting the discharge of liquid through the discharge opening.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 7:
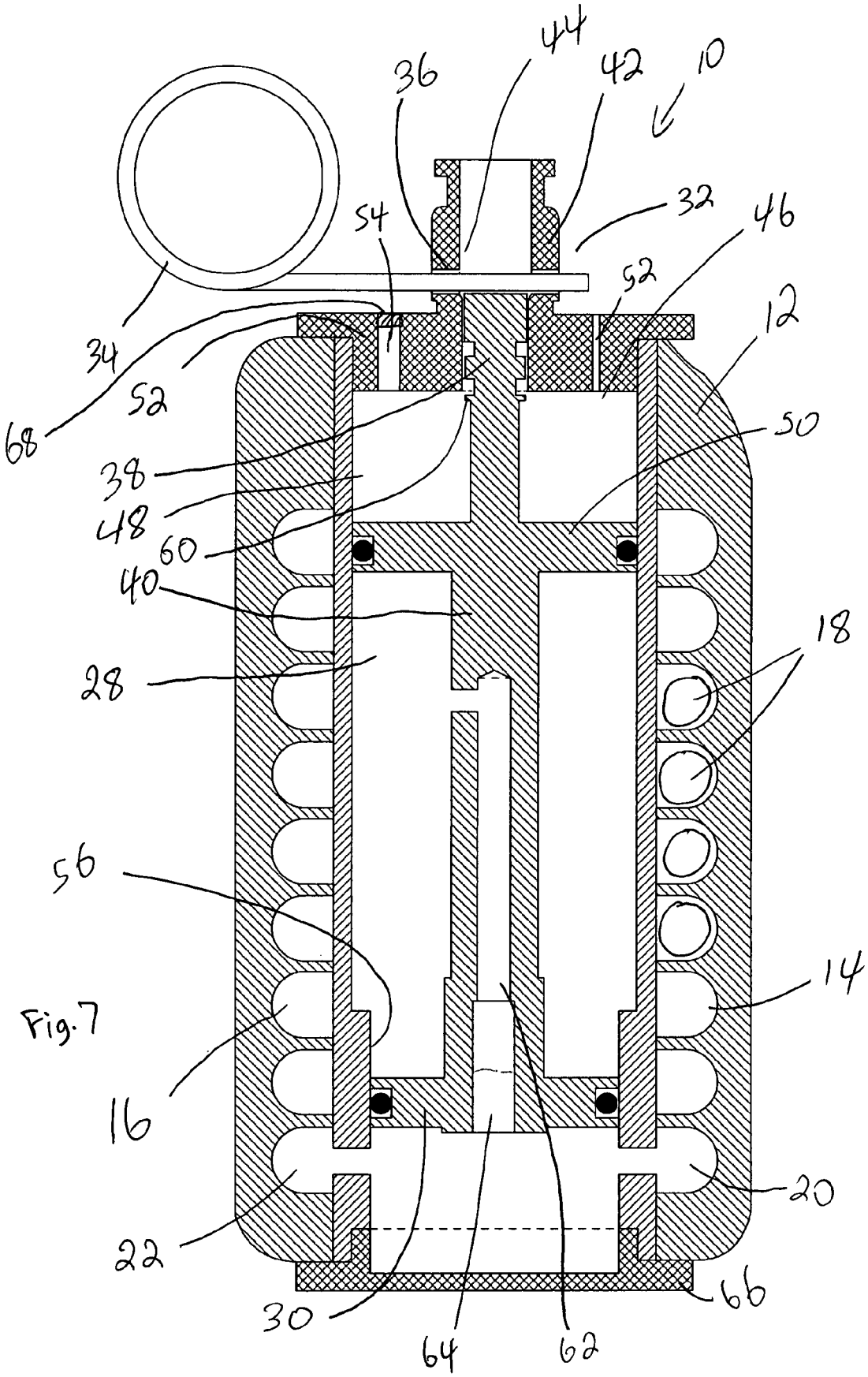
FIG. 7 is a long sectional view of the grenade shown in FIG. 1 showing the trigger mechanism in its locked state and the valve in its closed state.
Figure 8:
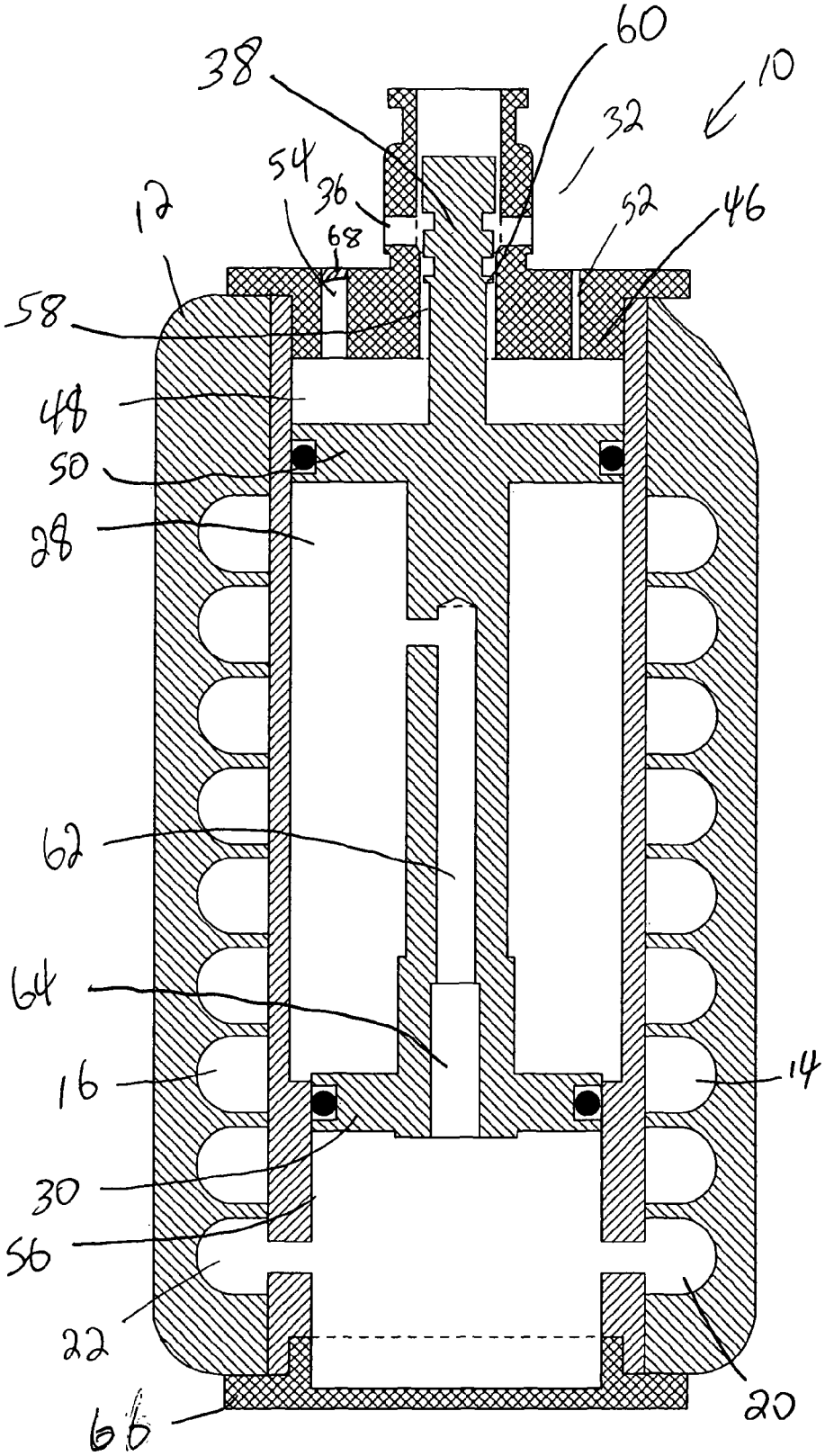
FIG. 8 is a long sectional view of the grenade shown in FIG. 1 showing the trigger mechanism in its unlocked state and showing the valve between its open and closed states.
Figure 9:
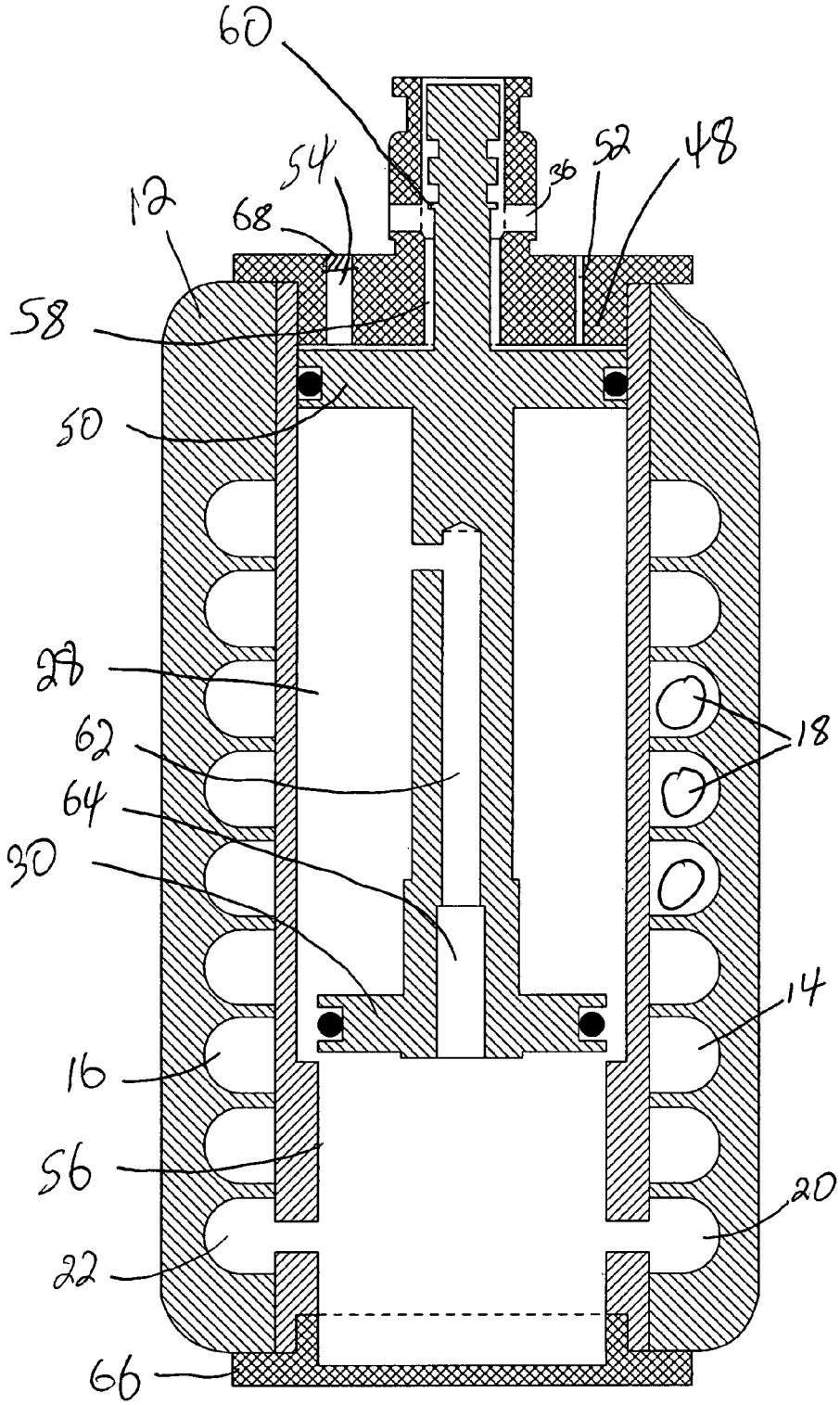
FIG. 9 is a long sectional view of the grenade shown in FIG. 1 showing the valve in its open state.

Referring firstly to FIGS. 7, 8 and 9, a grenade made in accordance with the present invention, shown generally as item 10 includes a housing 12 with a pair of spiral helical launch tubes 14 and 16 formed therein. Launch tubes 14 and 16 have breech ends 20 and 22 and muzzle ends 24 and 26 (see FIG. 5). A plurality of projectiles 18 are contained within the launch tubes. The grenade further includes a pressure source 28 for pressurizing the launch tubes sufficiently to launch the projectiles out of the launch tube. Pressure source 28 preferably consists of a gas reservoir for storing a quantity of compressed gas. Valve 30, is positioned between breech ends 22 and 20 and gas reservoir 28. Valve 30 is movable between a closed state, as shown in FIG. 7 where the valve prevents the flow of pressurized gas from reservoir 28 to breech ends 20 and 22, and an open state as shown in FIG. 9. As shall be explained later, valve 30 is biased towards its open position by the pneumatic pressure contained in gas reservoir 28. Trigger mechanism 32 is coupled to valve 30 and operates to hold valve 30 in its closed position. Trigger mechanism 32 includes a removable pin 34 which is contained in aperture 36 of collar 42. Collar 42 has a passage 44 dimensioned to receive end 38 of shaft 40 which is coupled to valve 30. When pin 34 remains in place in collar 42, the trigger mechanism is in its locked state and it prevents valve 30 from moving into its open position. Trigger mechanism 32 is placed in its unlocked state by pulling out pin 34 from collar 42, which frees end 38 to move in passage 44, thereby permitting the valve to move into its open state as shown in FIG. 9. A delay mechanism 46 is also coupled to valve 30 to slow down the movement of valve 30.

Delay mechanism 46 consists of a liquid reservoir 48 for holding a quantity of liquid such as water, the reservoir having a discharge opening 52 for slowly letting the liquid contained in the reservoir to escape. A piston 50 is contained in the reservoir and is coupled to valve 30 by shaft 40. Valve 30 is positioned in passage 56 which has a smaller cross sectional diameter than reservoir 48; therefore, when pin 34 is pulled out of collar 42, the gas pressure in chamber 28 acts against piston 50 to move the piston towards collar 42 pulling valve 30 along with it. As piston 50 moves towards collar 42, it forces water out of liquid reservoir 48 through discharge 54. Since discharge 54 is relatively narrow, it takes several seconds to empty the liquid reservoir, thereby delaying the movement of valve 30. When valve 30 clears passage 56, pressurized air from chamber 28 passes into breaches 20 and 22 thereby launching projectiles 18.

End 38 of shaft 40 is dimensioned to fit within passage 44. End 38 is provided with seal 60 which acts to seal passage 44 and prevent liquid from passing through the passage between the liquid reservoir 48 and aperture 36. However, end 38 is separated from passage 44 by a gap 58. When end 38 moves into the position shown in FIG. 9, seal 60 is past aperture 36 thereby permitting liquid to quickly drain from reservoir 48 and out aperture 36, which in turn permits valve 30 to quickly move into its fully open position.

The bottom of grenade 10 is provided with a removable cap 66. Shaft 40 is provided with an internal passage 62 having one way valve 64. When cap 66 is removed, the user can pressurize chamber 28 by applying an air line (not shown) to valve 64 to pressurize the gas chamber. Cap 66 can then be replaced. Water reservoir 48 can also be refilled by removing plug 68 and then filling the reservoir through opening 54. After filling the reservoir, plug 68 is replaced.

Figure 1:
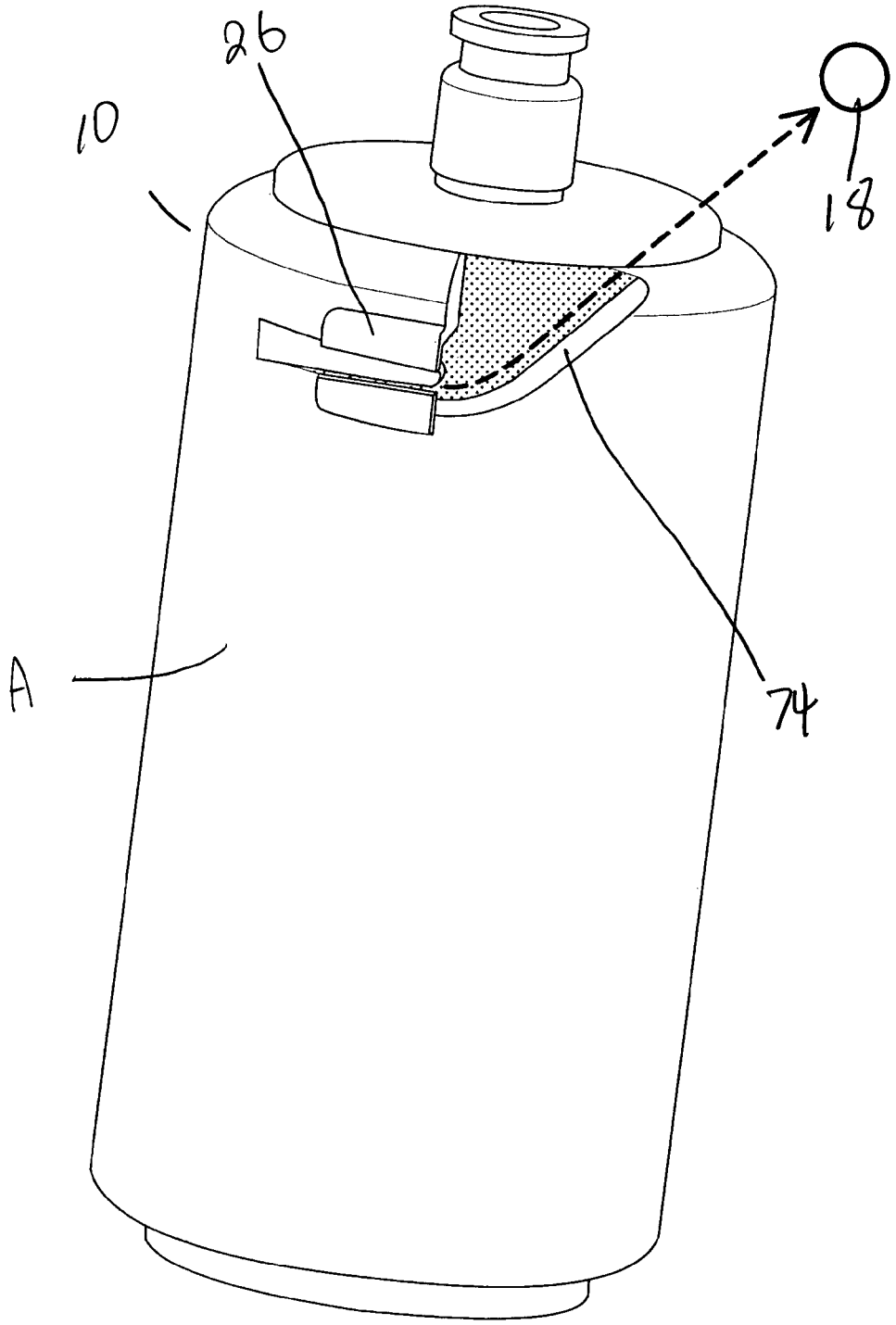
FIG. 1 is a perspective view of a grenade made in accordance with the present invention showing a projectile being launched from one side of the grenade.
Figure 2:
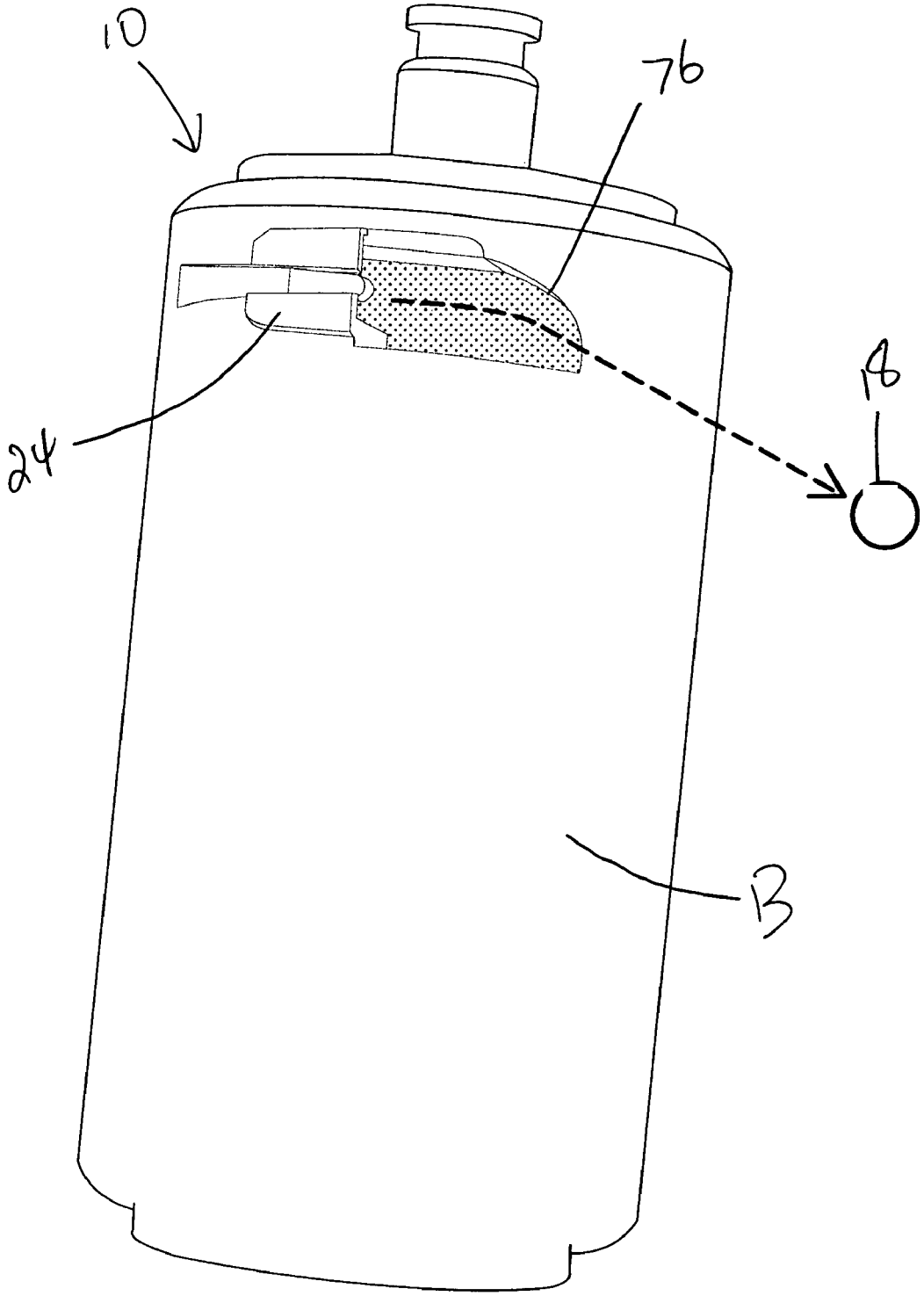
FIG. 2 is a perspective view of the grenade shown in FIG. 1 showing a projectile being launched from an opposite side of the grenade.
Figure 5:
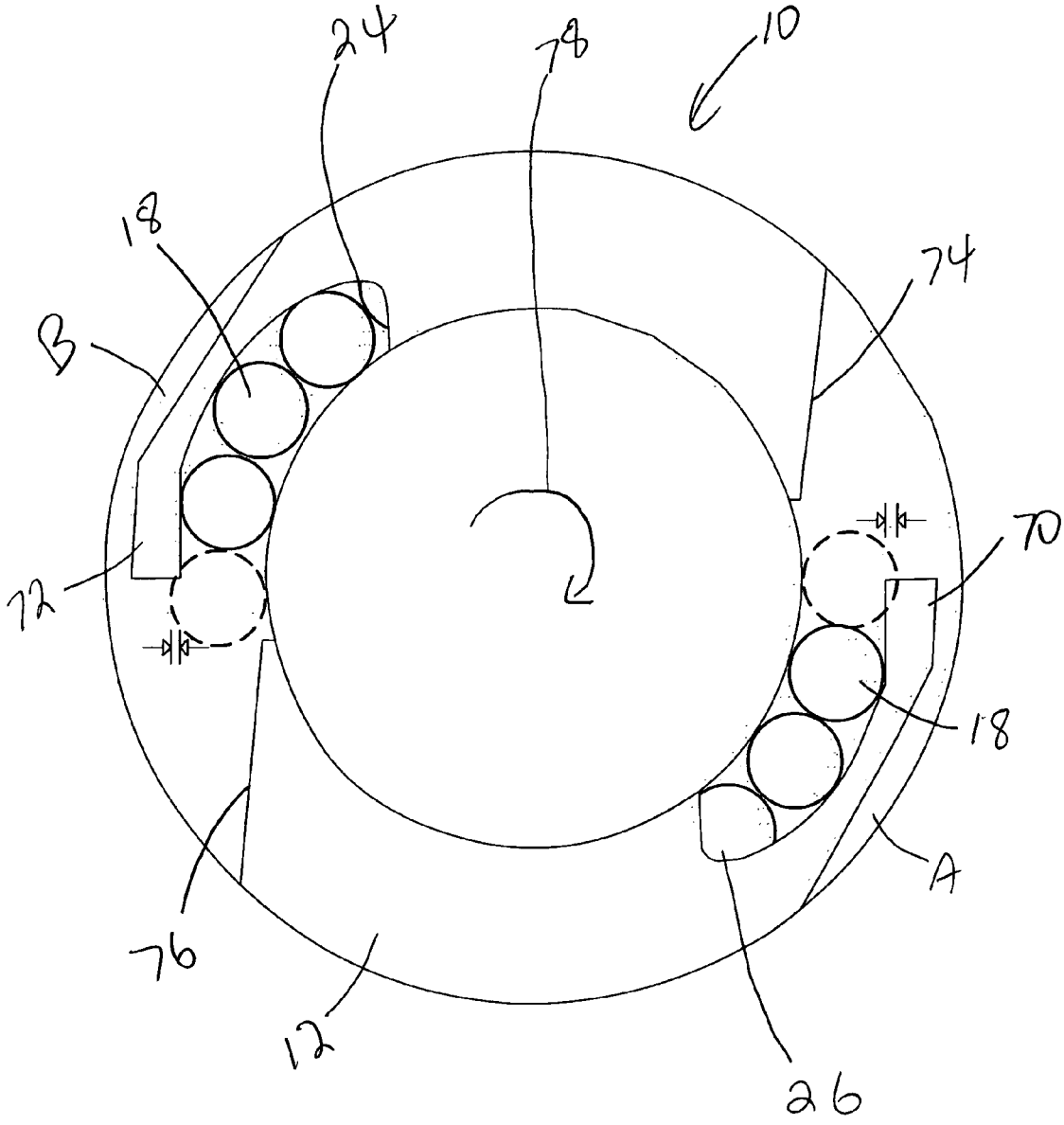
FIG. 5 is a top view of the grenade of FIG. 1 showing projectiles adjacent the muzzle ends of the launch tubes.
Figure 6:
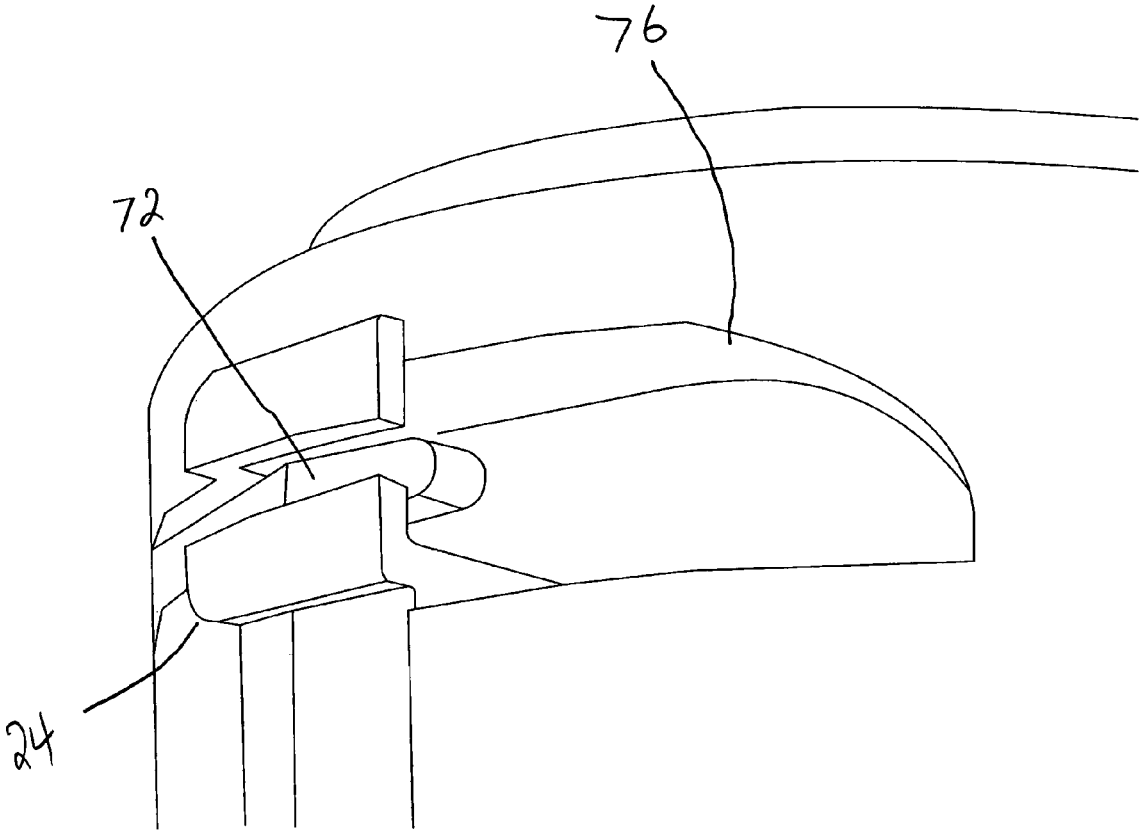
FIG. 6 is a perspective view of grenade showing the muzzle end of one of the launch tubes.

Referring now to FIG. 5, muzzle ends 24 and 26 are positioned on opposite sides B and A of grenade 10, respectively. Muzzle ends 24 and 26 are positioned such that projectiles 18 are launched out of the breech ends in opposite directions, thereby imparting a clockwise spin to the grenade as indicated by arrow 78. Projectiles 18 are held in muzzle ends 24 and 26 by fingers 72 and 70, respectively. Fingers 70 and 72 are dimensioned and configured to hold projectiles 18 in the muzzle end of the launch tubes until the launch tubes are pressurized sufficiently to force the projectiles past the fingers. Ramps 74 and 76 are formed on housing 12 of grenade 10 adjacent muzzle ends 26 and 24, respectively. As seen in FIG. 2, ramp 76 is dimensioned and configured to deflect projectiles 18 downwardly. As seen in FIG. 1, ramp 74 is dimensioned and configured to deflect projectiles 18 upwardly. As a result, additional movement is imparted to the grenade as projectiles are launched from the grenade. Since the projectiles are launched in different directions from different sides of the grenade, the movement of the grenade imparted by the launching projectiles is more random, which causes the projectiles to scatter in a more random way.

Figure 3:
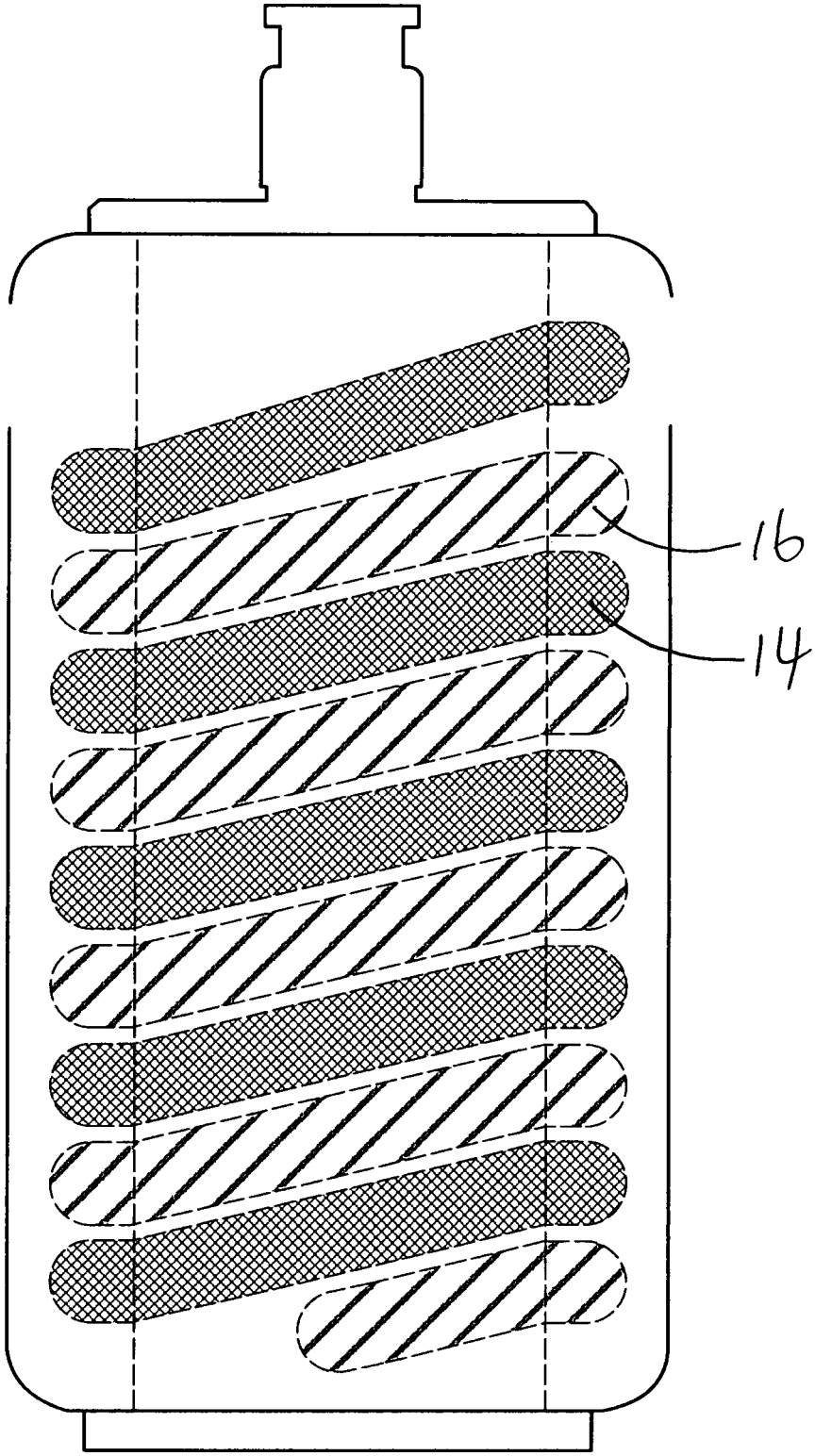
FIG. 3 is a schematic view of a grenade made in accordance with the present invention illustrating the helical arrangement of the launch tubes.
Figure 4:
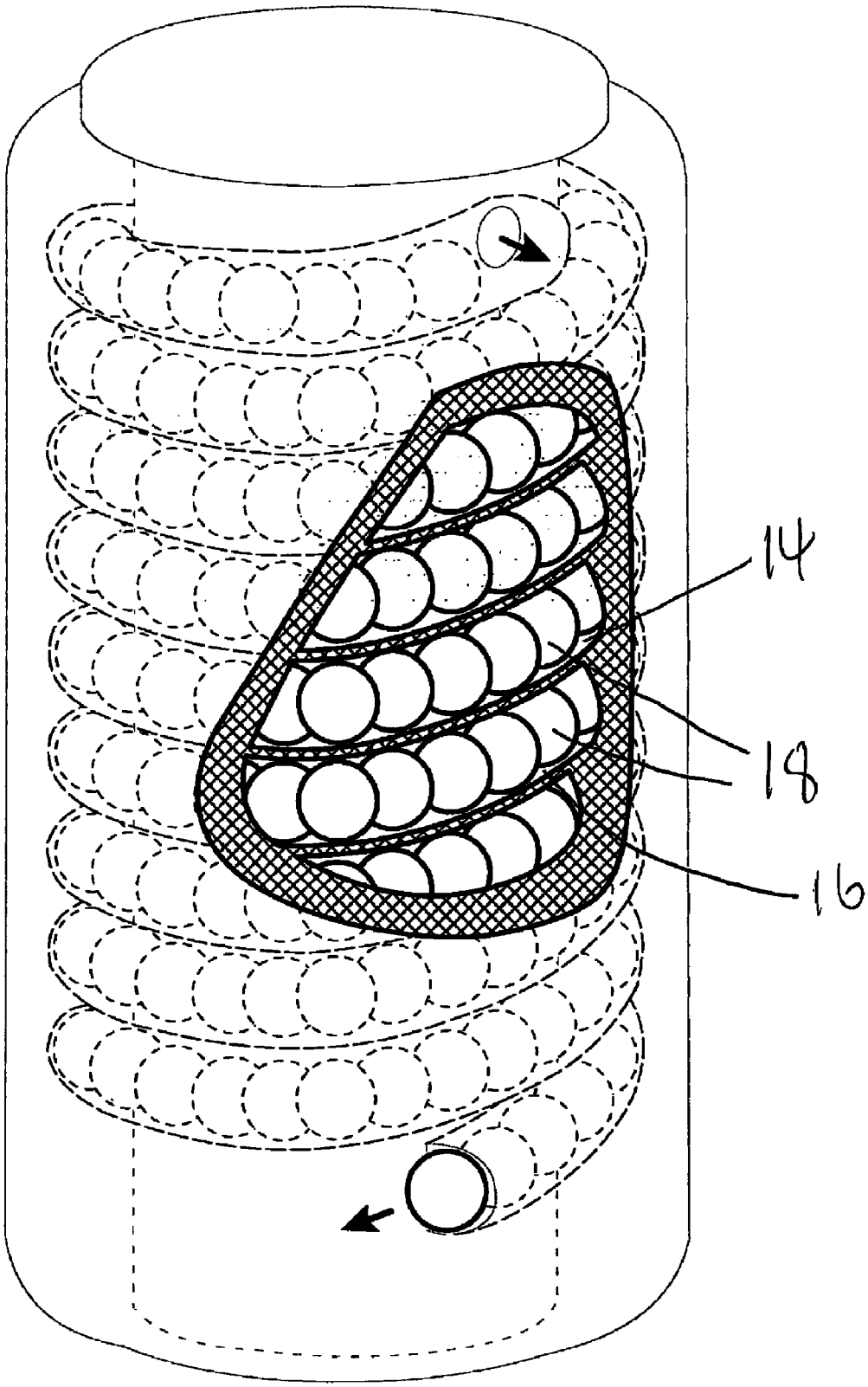
FIG. 4 is a perspective view of the grenade of FIG. 1 partly in cross section showing the launch tubes filled with projectiles.

Referring now to FIGS. 3 and 4, launch tubes 16 and 14 are preferably spiral and helical and arranged in a double helix arrangement. This arrangement maximizes the number of projectiles which can be packed into the grenade.

The present invention has many advantages over the prior art. In particular, the spiral launch tubes permit a large number of projectiles to be packed into the grenade. Furthermore, the positioning of the muzzle ends of the launch tubes on opposite sides of the grenade and the positioning of ramps to deflect the projectiles in different directions results in a more random scattering of the projectiles. Furthermore, the robust design of the valve mechanism and the delay mechanism permits easy refilling and recharging of the grenade as well as reliable performance. Finally, the use of launch tubes to store and project the projectiles results in a very efficient transfer of kinetic energy to the pellets, resulting in the pellets being launched a greater distance.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

What is claimed is:

1. A grenade comprising:

at least one spiral launch tube having a breech end and a muzzle end;

a plurality of projectiles loaded in said launch tube between the breech and muzzle ends, and a pressure supply coupled to the breech end of the launch tube for propelling the projectiles from the muzzle end of the launch tube wherein the pressure supply comprises a gas reservoir for storing compressed gas, and further comprising a valve interposed between the reservoir and the breech end of the launch tube for controlling the flow of compressed gas from the reservoir to the breech end of the launch tube, the valve moveable between a closed state and an open state wherein said compressed gas enters the breech end of the launch tube to propel the projectiles from the muzzle end, and further comprising a trigger mechanism coupled to the valve, the trigger mechanism operating between a locked state wherein the trigger mechanism keeps the valve in its closed state and an unlocked state wherein the valve is free to move into its open state, and further comprising a delay mechanism coupled to the valve for delaying the movement of the valve into its open state.

2. The grenade of claim 1 wherein the delay mechanism comprises a fluid reservoir for holding a quantity of fluid, the fluid reservoir having a discharge opening for discharging fluid from the fluid reservoir, a piston being retained in the fluid reservoir, the piston being coupled to the valve such that the valve and piston move together, the valve being biased towards its open state, the piston being oriented in the fluid reservoir such that as the valve moves into its open state the valve urges the piston to force the fluid out of the fluid reservoir and out the discharge opening, the discharge opening being dimensioned to delay the movement of the piston by restricting the discharge of fluid through the discharge opening.

3. The grenade of claim 2 wherein the trigger mechanism comprises a pin removably mounted to the housing, the pin being coupled to the piston to prevent the piston from moving when the pin is mounted to the housing.

4. The grenade of claim 2 wherein the fluid reservoir has a second discharge opening and wherein a shaft is mounted to the piston, the shaft having a distal end dimensioned and configured to slide snugly within the second discharge opening as the piston moves, the distal end of the shaft being dimensioned and configured such that the distal end of the shaft permits the fluid to quickly discharge through the second discharge opening immediately before the valve is in its open state.

5. The grenade of claim 4 wherein the trigger mechanism comprises a pin removably mounted to the housing, the pin being coupled to the shaft to prevent the piston from moving when the pin is mounted to the housing.

6. The grenade of claim 1 wherein the grenade comprises two spiral launch tubes, each of the launch tubes having a breech end and a muzzle end and a plurality of projectiles between the muzzle and breech ends, the breech ends of the launch tubes being coupled to the gas reservoir, the grenades having opposite sides and the muzzle ends of the launch tubes positioned on opposite sides of the grenade.

7. The grenade of claim 6 wherein a first ramp is formed on the housing adjacent the muzzle end of one of the launch tubes, and wherein a second ramp is formed on the housing adjacent the muzzle end of the other launch tube, the first and second ramps being dimensioned and configured to deflect the projectiles.

8. The grenade of claim 7 wherein the first ramp is configured to deflect the projectiles in a first direction and the second ramp is configured to deflect the projectiles in a second direction, the second direction being different than the first direction.

9. A grenade comprising:

a housing;

at least one launch tube contained in the housing, said launch tube having a breech end and a muzzle end;

a plurality of projectiles loaded in said launch tube between the breech and muzzle ends;

a gas reservoir for storing a compressed gas coupled to the breech end of the launch tube;

a valve interposed between the reservoir and the breech end of the launch tube for controlling the flow of compressed gas from the reservoir to the breech end of the launch tube, the valve moveable between a closed state and an open state wherein said compressed gas enters the breech end of the launch tube to propel the projectiles from the muzzle end, the valve being biased towards its open state;

a trigger mechanism coupled to the valve, the trigger mechanism operating between a locked state wherein the trigger mechanism holds the valve in its closed state and an unlocked state wherein the valve is free to move into its open state;

a delay mechanism coupled to the valve for slowing the movement of the valve into its open state, the delay mechanism comprising a fluid reservoir for holding a quantity of fluid, the fluid reservoir having a discharge opening for discharging fluid from the fluid reservoir, the valve being coupled to a piston such that the valve and piston move together, the piston being positioned in the fluid reservoir to force the fluid out of the fluid reservoir as the valve moves into its open position, the discharge opening being dimensioned to delay the movement of the piston by restricting the discharge of fluid through the discharge opening.

10. The grenade of claim 9 wherein the trigger mechanism comprises a pin removably mounted to the housing, the pin being coupled to the piston to prevent the piston from moving when the pin is mounted to the housing.

11. The grenade of claim 9 wherein the fluid reservoir has a second discharge opening and wherein a shaft is mounted to the piston, the shaft having a distal end dimensioned and configured to slide snugly within the second discharge opening as the piston moves, the distal end of the shaft being dimensioned and configured such that the distal end of the shaft permits the fluid to quickly discharge through the second discharge opening immediately before the valve is in its open state.

12. The grenade of claim 11 wherein the trigger mechanism comprises a pin removably mounted to the housing such that the pin prevents the piston from moving when the pin remains mounted to the housing.

13. The grenade of claim 9 wherein the gas reservoir and the fluid reservoir are continuous with one another and are separated by the piston, the piston being physically coupled to the valve such that the pressurized gas in the gas reservoir acts against the piston to bias the valve towards its open position.

14. The grenade of claim 13 wherein the valve comprises a collar interposed between the breech end of the launch tube and the gas reservoir and a seal member, the collar being dimensioned and configured to carry pressurized gas from the gas reservoir to the breech end of the launch tube when the collar is unobstructed, the seal member being movable between a first position wherein the seal member seals off the collar and a second position wherein the seal member does not obstruct the collar, the seal member being mounted to the piston by a connecting member.

15. The grenade of claim 14 wherein the collar comprises a tubular passage and the seal is dimensioned and configured to slide within the collar, the collar being further dimensioned such that the seal member is out of the collar when the piston has moved the seal member into its second position.

16. The grenade of claim 9 wherein the launch tube is spiraled.

17. The grenade of claim 9 wherein the grenade comprises two spiraled launch tubes, each launch tube having a breech and muzzle end, the breech ends of both launch tubes being coupled to the valve.

18. The grenade of claim 17 wherein the spiraled launch tubes are arranged in a double helical arrangement.

19. A grenade comprising:

a housing;

a plurality of launch tubes contained in the housing, said launch tubes each having a breech end and a muzzle end;

a plurality of projectiles loaded in each of the launch tubes between the breech and muzzle ends;

a gas reservoir for storing a compressed gas coupled to the breech ends of each launch tube;

a valve interposed between the reservoir and the breech end of the launch tubes for controlling the flow of compressed gas from the reservoir to the breech end of the launch tubes, the valve moveable between a closed state and an open state wherein said compressed gas enters the breech end of the launch tubes to propel the projectiles from the muzzle end of the launch tubes, the valve being biased towards its open state;

a trigger mechanism coupled to the valve, the trigger mechanism operating between a locked state wherein the trigger mechanism holds the valve in its closed state and an unlocked state wherein the valve is free to move into its open state;

a delay mechanism coupled to the valve for slowing the movement of the valve into its open state, the delay mechanism comprising a fluid reservoir for holding a quantity of fluid, the fluid reservoir having a discharge opening for discharging fluid from the fluid reservoir, the valve being coupled to a piston such that the valve and piston move together, the piston being positioned in the fluid reservoir to force the fluid out of the fluid reservoir as the valve moves into its open position, the discharge opening being dimensioned to delay the movement of the piston by restricting the discharge of fluid through the discharge opening;

a plurality of ramp portions formed on the housing immediately adjacent the muzzle ends, the ramp portions dimensioned and configured to deflect the projectiles as they are launched out of the muzzle ends.

* * * * *